US011721904B2

(12) United States Patent
Ling et al.

(10) Patent No.: US 11,721,904 B2
(45) Date of Patent: Aug. 8, 2023

(54) ANTENNA AND WIRELESS COMMUNICATION DEVICE

(71) Applicant: Realtek Semiconductor Corp., HsinChu (TW)

(72) Inventors: Ching-Wei Ling, HsinChu (TW); Chih-Pao Lin, HsinChu (TW)

(73) Assignee: Realtek Semiconductor Corp., HsinChu (TW)

( * ) Notice: Subject to any disclaimer, the term of this patent is extended or adjusted under 35 U.S.C. 154(b) by 24 days.

(21) Appl. No.: 17/349,864

(22) Filed: Jun. 16, 2021

(65) Prior Publication Data

US 2022/0029299 A1 Jan. 27, 2022

(30) Foreign Application Priority Data

Jul. 21, 2020 (TW) ..... 109124589

(51) Int. Cl.
*H01Q 9/42* (2006.01)

(52) U.S. Cl.
CPC ..... *H01Q 9/42* (2013.01)

(58) Field of Classification Search
CPC ..... H01Q 9/42; H01Q 1/20
See application file for complete search history.

(56) References Cited

U.S. PATENT DOCUMENTS 7,106,259 B2 9/2006 Tseng
8,164,524 B2 * 4/2012 Tang ..... H01Q 5/364 343/702
8,405,557 B2 * 3/2013 Lu ..... H01Q 5/371 343/893
2003/0098812 A1 * 5/2003 Ying ..... H01Q 19/005 343/702
2004/0070537 A1 4/2004 Kadambi
2009/0195478 A1 8/2009 Tsai
2012/0007784 A1 * 1/2012 Ling ..... H01Q 9/0442 343/843
2012/0139792 A1 * 6/2012 Pan ..... H01Q 5/357 343/700 MS
2012/0262354 A1 * 10/2012 He ..... H01Q 9/42 343/833
2014/0118194 A1 * 5/2014 Gavilan ..... H01Q 9/42 343/700 MS
2015/0002340 A1 * 1/2015 Liou ..... H01Q 9/42 343/700 MS
2015/0236422 A1 * 8/2015 You ..... H01Q 9/42 343/729
2020/0067178 A1 * 2/2020 Hu ..... H01Q 1/36

FOREIGN PATENT DOCUMENTS

TW 201203698 A1 1/2012

* cited by examiner

*Primary Examiner* — Hai V Tran
*Assistant Examiner* — Michael M Bouizza
(74) *Attorney, Agent, or Firm* — Winston Hsu

(57) ABSTRACT

An antenna includes a radiation body and a feed pin. The radiation body includes a first radiation branch and a second radiation branch. The first radiation branch extends along a first direction. The second radiation branch extends along a second direction. The feed pin extends outward from the radiation body along a third direction. The first direction is perpendicular to the second direction and the third direction.

16 Claims, 10 Drawing Sheets

ANTENNA AND WIRELESS COMMUNICATION DEVICE

BACKGROUND OF THE INVENTION

1. Field of the Invention

The invention relates to an antenna, more particular to a miniaturized broadband antenna which is able to be directly applied to various electronic products.

2. Description of the Prior Art

With the development and progress of wireless communication technology, the application of Internet of Things (IoT) has become increasingly widespread. The scope of the smart home application is to configure wireless module in various home electronic devices, so that people can remotely and instantly control the working status of the home electronic devices, such as electric cooker, coffee machine, air conditioner, refrigerator, washing machine, and so on, through wireless communication, so as to realize the vision of smart life.

In the application of smart home products, as compared to customization the wireless modules for each product, the assembly method of combining a single miniaturized wireless module with the various product greatly improves the convenience of manufacturing the products since the internal structure of the products and the size of the main circuit boards are not all the same and the product appearances are diversified. However, the impedance bandwidth of the antenna is usually a limitation when designing small wireless modules. Therefore, how to design a miniaturized, high-efficiency, broadband and low-cost antenna in a limited space is an important research topic in this field.

SUMMARY OF THE INVENTION

It is an objective of the invention to provide a single and miniaturized broadband antenna design capable of being applied to various electronic products.

According to an embodiment of the invention, an antenna comprises a radiation body and a feed pin. The radiation body comprises a first radiation branch and a second radiation branch. The first radiation branch extends along a first direction and the second radiation branch extends along a second direction. The feed pin extends outward from the radiation body along a third direction. The first direction is perpendicular to the second direction and the third direction.

According to another embodiment of the invention, a wireless communication device comprises a circuit substrate and an antenna. The circuit substrate comprises at least a first connection portion, a second connection portion and a ground plane. The antenna comprises a radiation body, a feed pin and a short-circuit pin. The radiation body comprises a first radiation branch and a second radiation branch. The first radiation branch extends along a first direction and the second radiation branch extends along a second direction. The feed pin extends outward from the radiation body along a third direction and is coupled to the first connection portion. The short-circuit pin extends outward from the radiation body along the third direction and is coupled to the second connection portion and the ground plane. The first direction is perpendicular to the second direction and the third direction.

According to yet another embodiment of the invention, a wireless communication device comprises a circuit motherboard, a circuit substrate and an antenna. The circuit substrate is located on the circuit motherboard and comprises at least a first connection portion, a second connection portion and a ground plane. The antenna comprises a radiation body, a feed pin and a short-circuit pin. The radiation body comprises a first radiation branch and a second radiation branch. The first radiation branch extends along a first direction and the second radiation branch extends along a second direction. The feed pin extends outward from the radiation body along a third direction and is coupled to the first connection portion. The short-circuit pin extends outward from the radiation body along the third direction and is coupled to the second connection portion and the ground plane. The first direction is perpendicular to the second direction and the third direction.

These and other objectives of the present invention will no doubt become obvious to those of ordinary skill in the art after reading the following detailed description of the preferred embodiment that is illustrated in the various figures and drawings.

DETAILED DESCRIPTION

The invention provides an antenna structure that is integrally formed in one piece, single-feed, and capable of supporting broadband operations. The proposed antenna structure is designed based on one quarter wavelength antenna and comprises dual radiation branches. By adjusting two resonant frequencies corresponding to the two radiation branches, the characteristics of miniaturized and broadband of the antenna are achieved. Based on the proposed antenna structure, not only the size of the antenna is reduced so that the proposed antenna can be applied to a small-size circuit substrate, but also good antenna radiation characteristics can be achieved.

In addition, since the antenna is integrally formed in one piece, only one metal conductor is needed for manufacturing the proposed antenna. The proposed antenna can be easily fabricated after properly bending the metal conductor and the proposed antenna and the circuit substrate of a wireless communication module can be directly soldered together. Therefore, the proposed antenna has the advantages of simple fabrication, low cost and easy assembly, and also has the industrial applicability.

Figure 1:
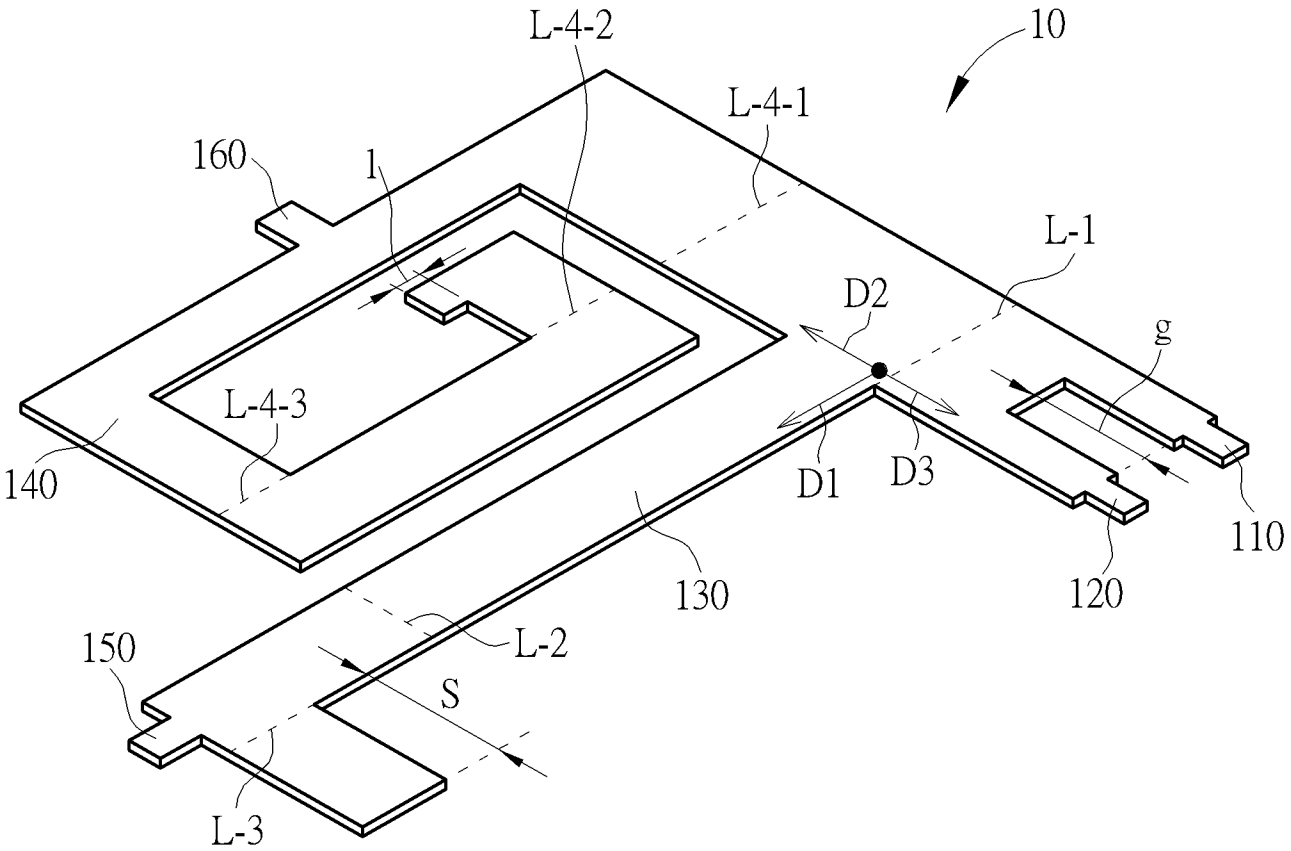
FIG. 1 shows an exemplary antenna structure according to an embodiment of the invention.

FIG. 1 shows an exemplary antenna structure according to an embodiment of the invention. In the embodiment of the invention, the antenna 10 may be implemented as a planer antenna or a three-dimensional antenna. FIG. 1 shows the expanded view of the antenna body.

The antenna 10 may comprise at least a radiation body and a feed pin 110. The radiation body may at least comprise radiation branches 130 and 140. In the embodiments of the invention, the antenna 10 may selectively comprise a short-circuit pin 120, and the antenna 10 may be a planar inversed-F antenna (in the embodiment where the antenna 10 comprises the short-circuit pin 120) or a monopole antenna (in the embodiment where the antenna 10 does not comprise the short-circuit pin 120).

According to an embodiment of the invention, the radiation branch 130 may comprise a plurality of radiation portions, where at least one radiation portion extends along the first direction D1. The radiation branch 140 may comprise a plurality of radiation portions, where at least one radiation portion extends along the second direction D2. In addition, the feed pin 110 and the short-circuit pin 120 may extend outward from the radiation body along the third direction D3, where the first direction D1 may be perpendicular or substantially perpendicular to the second direction D2 and the third direction D3.

In addition, the antenna 10 may further comprise support portions 150 and 160 extending outward from the radiation body. The feed pin 110, short-circuit pin 120 and the support portions 150 and 160 may be connected to the circuit substrate.

Figure 2:
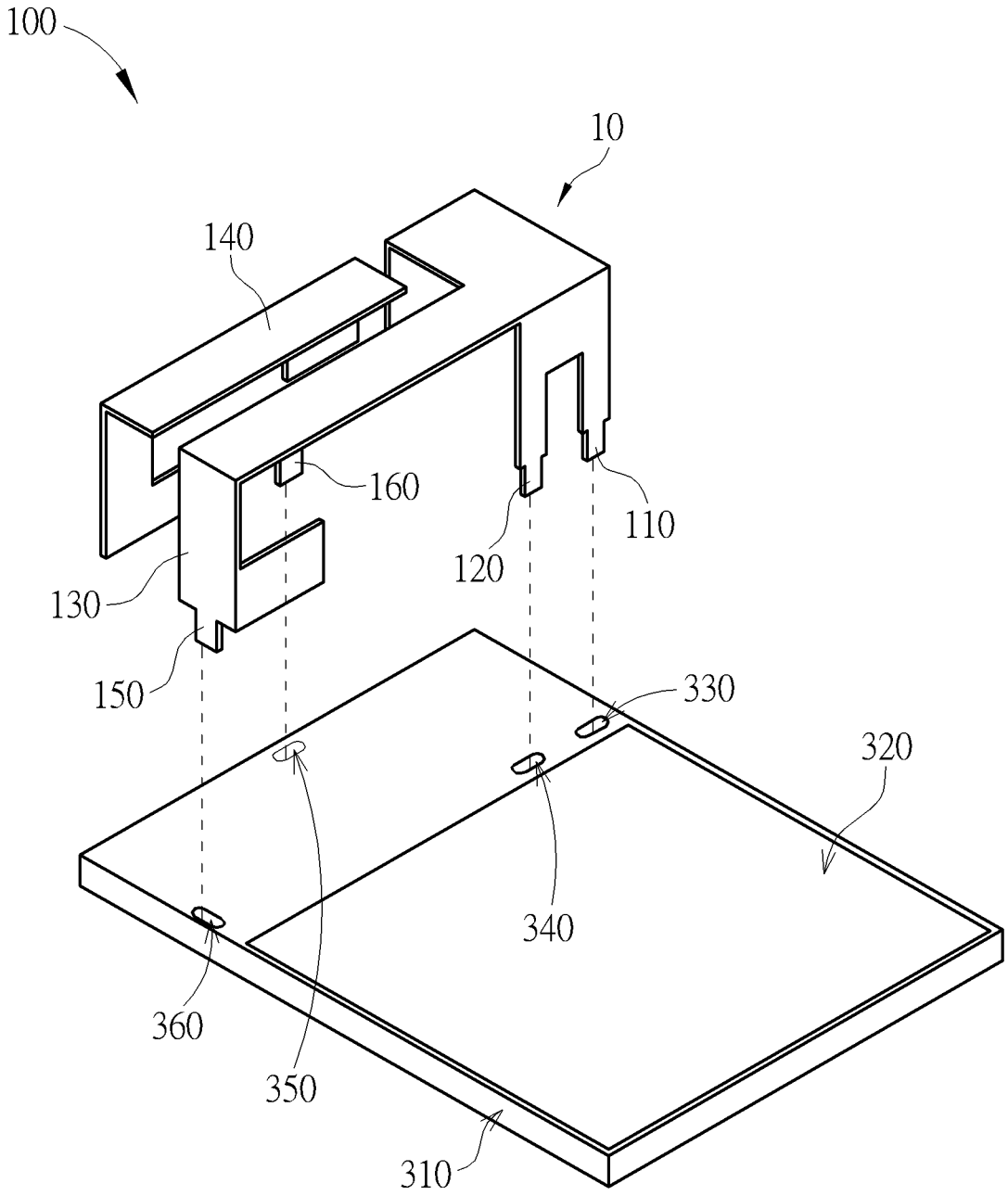
FIG. 2 shows an exemplary three-dimensional antenna structure according to an embodiment of the invention.

FIG. 2 shows an exemplary three-dimensional antenna structure according to an embodiment of the invention. Antenna 10 may be installed on the circuit substrate 310. In this embodiment, the antenna 10 is in the form of an inverted F antenna. The short-circuit pin 120 is connected to the ground plane 320 of the circuit substrate 310, and there is a gap between the feed pin 110 and the short-circuit pin 120 and the ground plane 320, where the length of the gap is g (as shown in FIG. 1). There are fourth connection portions 330, 340, 350 and 360, that could be utilized for inserting the antenna 10 onto the circuit substrate 310 and fixing it. The connection portion 330 is connected to the feeding terminal of the circuit substrate 310, the connection portion 340 is connected to the ground plane 320, and the connection portions 350 and 360 are respectively connected to the support portions 150 and 160 so as to enhance the stability of the antenna 10. The ends of the feed pin 110 and the short-circuit pin 120 may be implemented in a stepped shape to fix the height of the antenna 10. It should be noted that in some embodiments of the invention, the connection portions 350 and 360 may be removed. That is, the antenna 10 may be installed on the circuit substrate 310 by simply connecting the feed pin 110 and the short-circuit pin 120 to the connection portions 330 and 340, respectively.

In the embodiments of the invention, the radiation branch 130 may be used to transmit and receive a signal of a first resonant frequency, and the radiation branch 140 may be used to transmit and receive a signal of a second resonant frequency, wherein the first resonant frequency and the second resonant frequency are close to the operating frequency of the antenna 10. For example, in an embodiment of the invention, the first resonant frequency may be 2.41 GHz, the second resonant frequency may be 2.46 GHz, and the operating frequency of the antenna 10 may be 2.45 GHz. By adjusting the overall metal trace length of each branch separately, the first resonant frequency and the second resonant frequency may be adjusted as well. By adequately adjusting the first resonant frequency and the second resonant frequency, the broadband antenna operation can be achieved. In the embodiments of the invention, the 10 dB bandwidth of the antenna 10 may reach 80 MHz. The operating frequency band may be designed to be 2.4 GHz-2.48 GHz, and there are two resonant frequencies in the operating frequency band. In addition, according to an embodiment of the invention, taking the antenna having 2.4 GHz operating frequency as an example, the circuit substrate 310 may be a Flame Retardant 4 (FR4) substrate with a thickness of 0.6 millimeter (mm) and a size of 15 mm×20 mm (equivalent to $0.12\lambda\times0.16\lambda$), where k is the wavelength of the signal having the operating frequency of 2.4 GHz, and the size of antenna 10 can be only 14.2 mm×5.0 mm×5.0 mm (equivalent to $0.11\lambda\times0.04\lambda\times0.04\lambda$). Therefore, compared to the size of the circuit substrate 310, the antenna 10 can be realized as a miniaturized broadband antenna.

Figure 3:
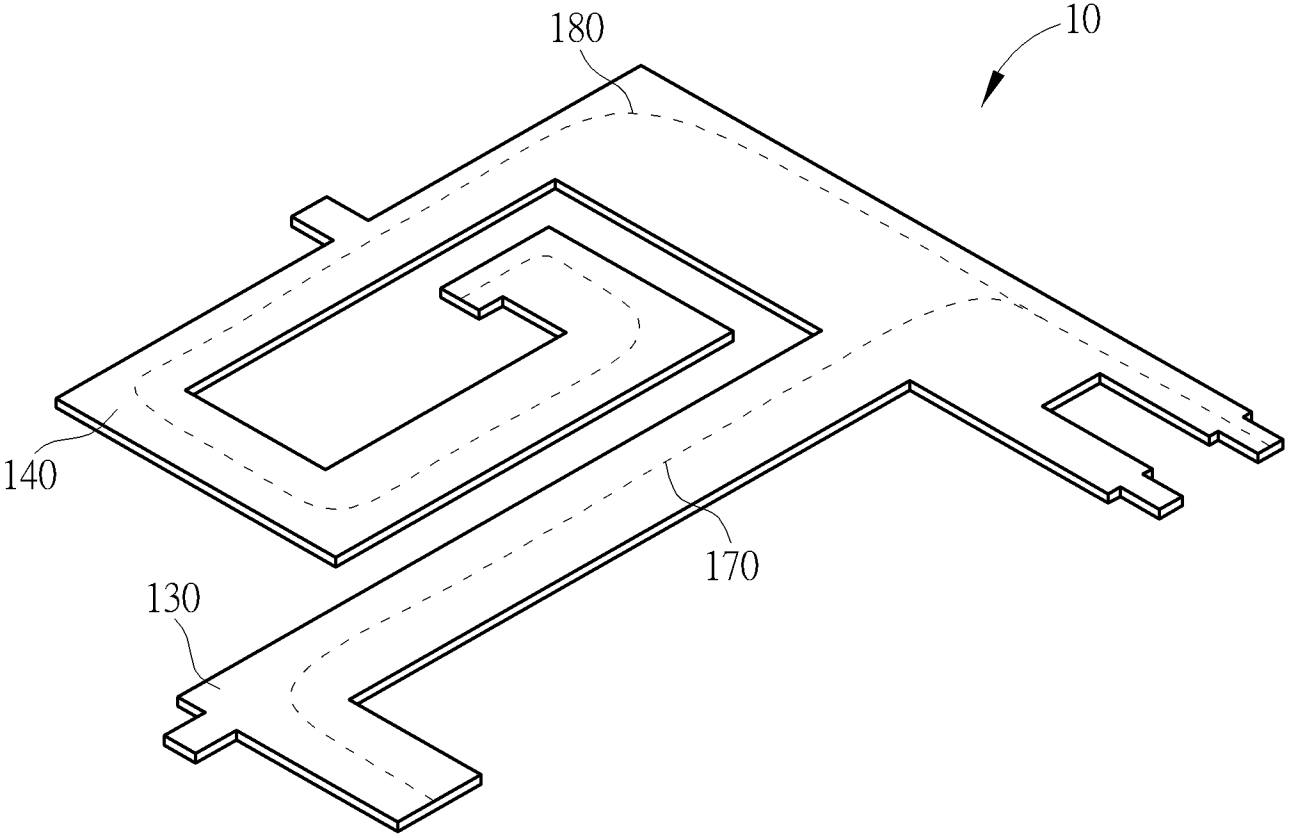
FIG. 3 shows the equivalent current path of the miniaturized broadband antenna according to an embodiment of the invention.

FIG. 3 shows the equivalent current path of the miniaturized broadband antenna according to an embodiment of the invention. In the embodiment of the invention, the radiation branch 130 may provide the equivalent current path 170 of the first resonant frequency. The equivalent current at the first resonant frequency may flow from the feed pin 110 to the open-circuit node at the end of the radiation branch 130. The radiation branch 140 may provide the equivalent current path 180 of the second resonant frequency. The equivalent current at the second resonant frequency may flow from the feed pin 110 to the open-circuit node at the end of the radiation branch 140. In the embodiments of the invention, by respectively adjusting the metal trace length of each branch, the length of the equivalent current path may be equal to or approaches one quarter wavelength of the signal, which optimizes the radiation efficiency of the antenna.

Figure 4:
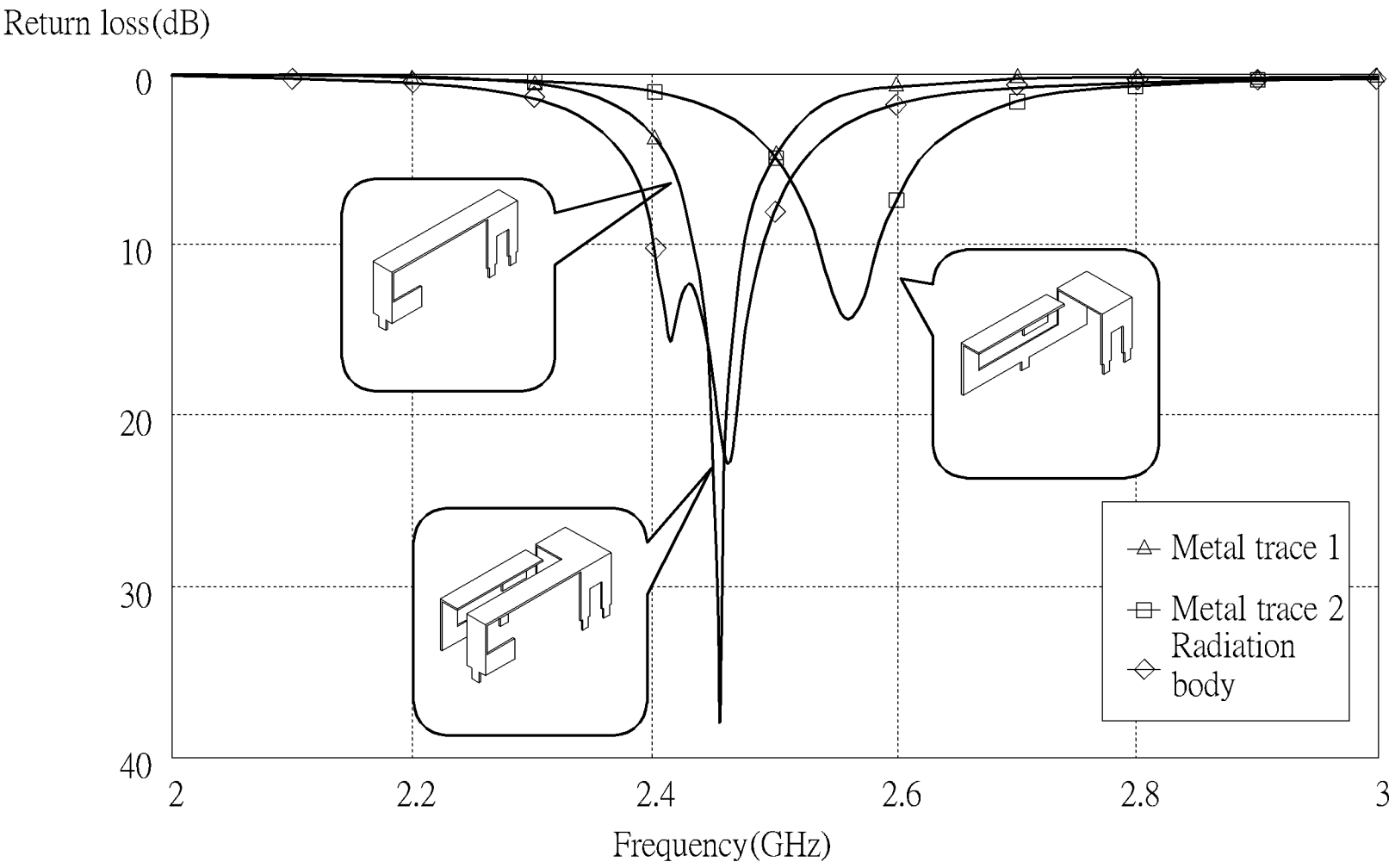
FIG. 4 is a schematic diagram showing the return loss of the miniaturized broadband antenna according to an embodiment of the invention.

FIG. 4 is a schematic diagram showing the return loss of the miniaturized broadband antenna according to an embodiment of the invention. The radiation branch 130 formed by the metal trace 1 provides operations at the first resonant frequency. The radiation branch 140 formed by the metal trace 2 provides operations at the second resonant frequency. The radiation body is the combination of the metal trace 1 and the metal trace 2. By adjusting the lengths of the metal traces 1 and 2, the first resonant frequency and the second resonant frequency may be adjusted as well. Based on the effect of combining these two resonant frequencies, the band in which the overall return loss of the radiation body being less than 10 dB will have a sufficient bandwidth, for example, 80 MHz.

It should be noted that, in the embodiment of the invention, the antenna structure shown in FIG. 2 should not be a limit of the possible antenna structures when the antenna 10 is implemented as a three-dimensional antenna. In the embodiments of a three-dimensional antenna, the antenna 10 or the radiation body may comprise at least one bent portion, for example, the radiation body may be bent, for example, bent 90 degrees, along a fold line L-1 which is perpendicular to the third direction D3, so as to make the second direction D2 perpendicular to the third direction D3, and make the feed pin 110 and/or the short-circuit pin 120 can be inserted in the circuit substrate 310 in a plug-in form or soldered on the circuit substrate 310 in a soldering form.

In some embodiments of the invention, the antenna 10 or the radiation body may comprise a plurality of bent portions, for example, the radiation body may also be bent along a fold line L-2 which is perpendicular to the first direction D1, and may be further bent along a fold line L-3 which is parallel to the first direction D1, so as to form the three-dimensional radiation branch 130 as shown in FIG. 2. In addition, the radiation body may also be bent along the fold lines L-4-1, L-4-2 and L-4-3 perpendicular to the second direction D2, so as to form the three-dimensional radiation branch 140 as shown in FIG. 2.

The plurality of bent portions make the three-dimensional radiation branch 130 and the three-dimensional radiation branch 140 to have a plurality of radiation portions respectively located on different planes.

Figure 5:
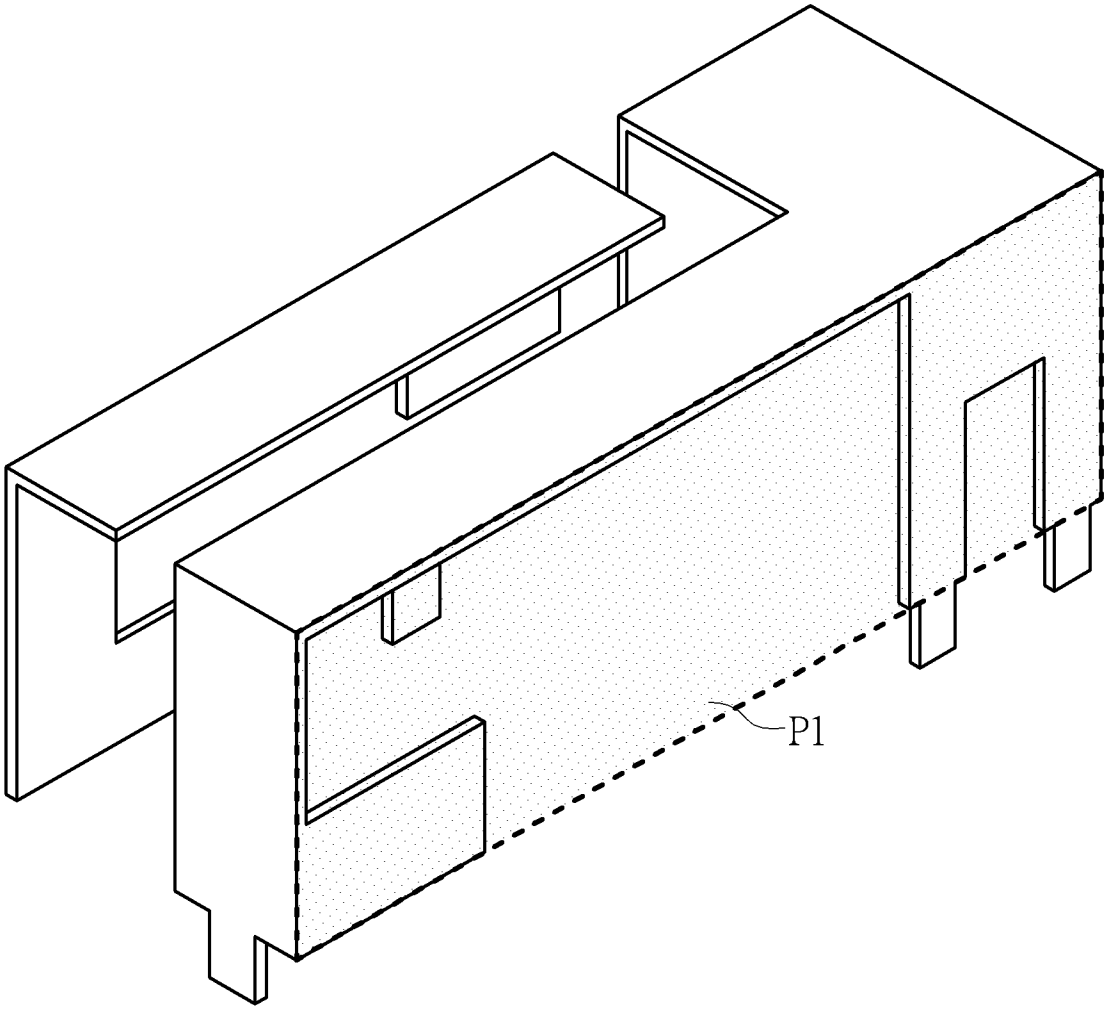
FIG. 5 shows the first plane of the proposed three-dimensional antenna design as shown in FIG. 2 according to an embodiment of the invention.
Figure 6:
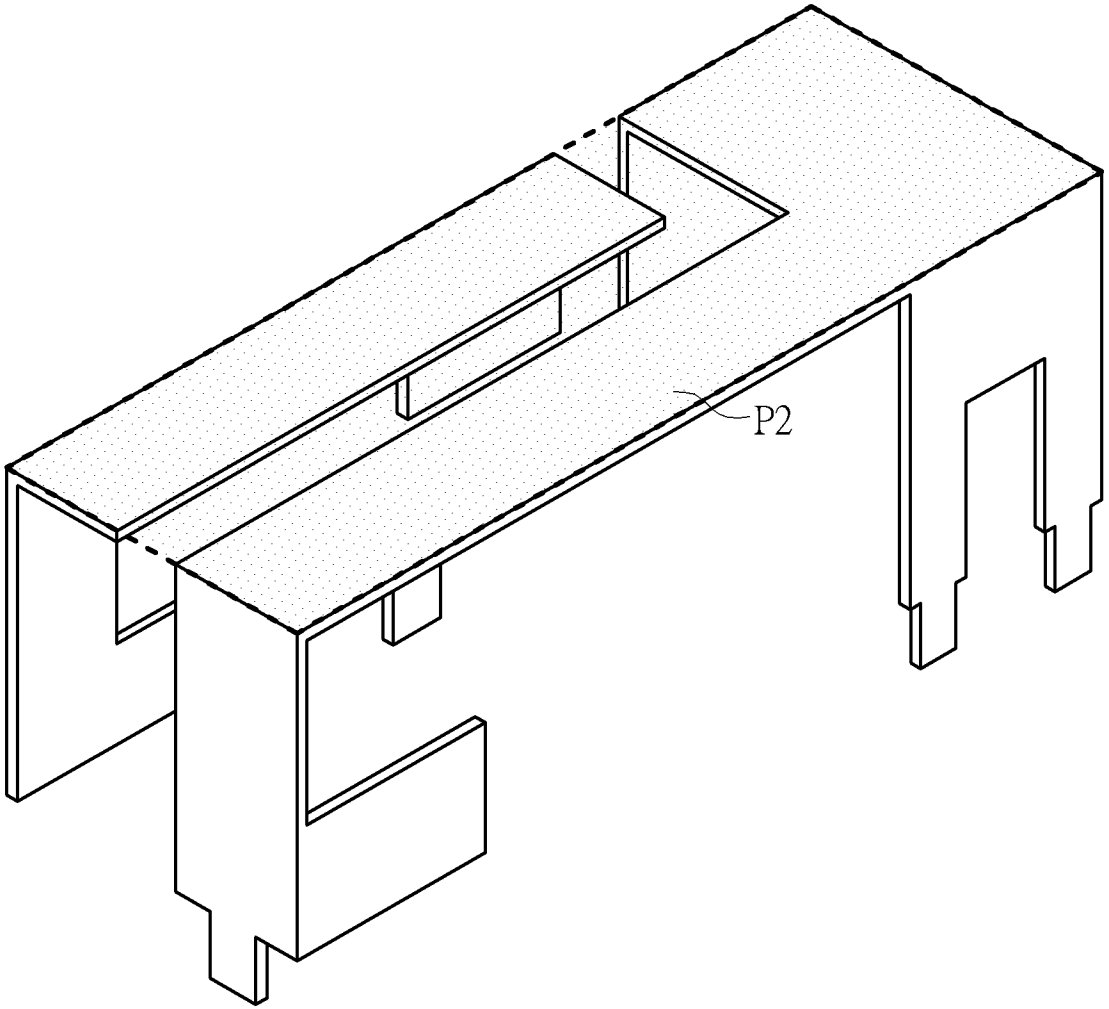
FIG. 6 shows the second plane of the proposed three-dimensional antenna design as shown in FIG. 2 according to an embodiment of the invention.
Figure 7:
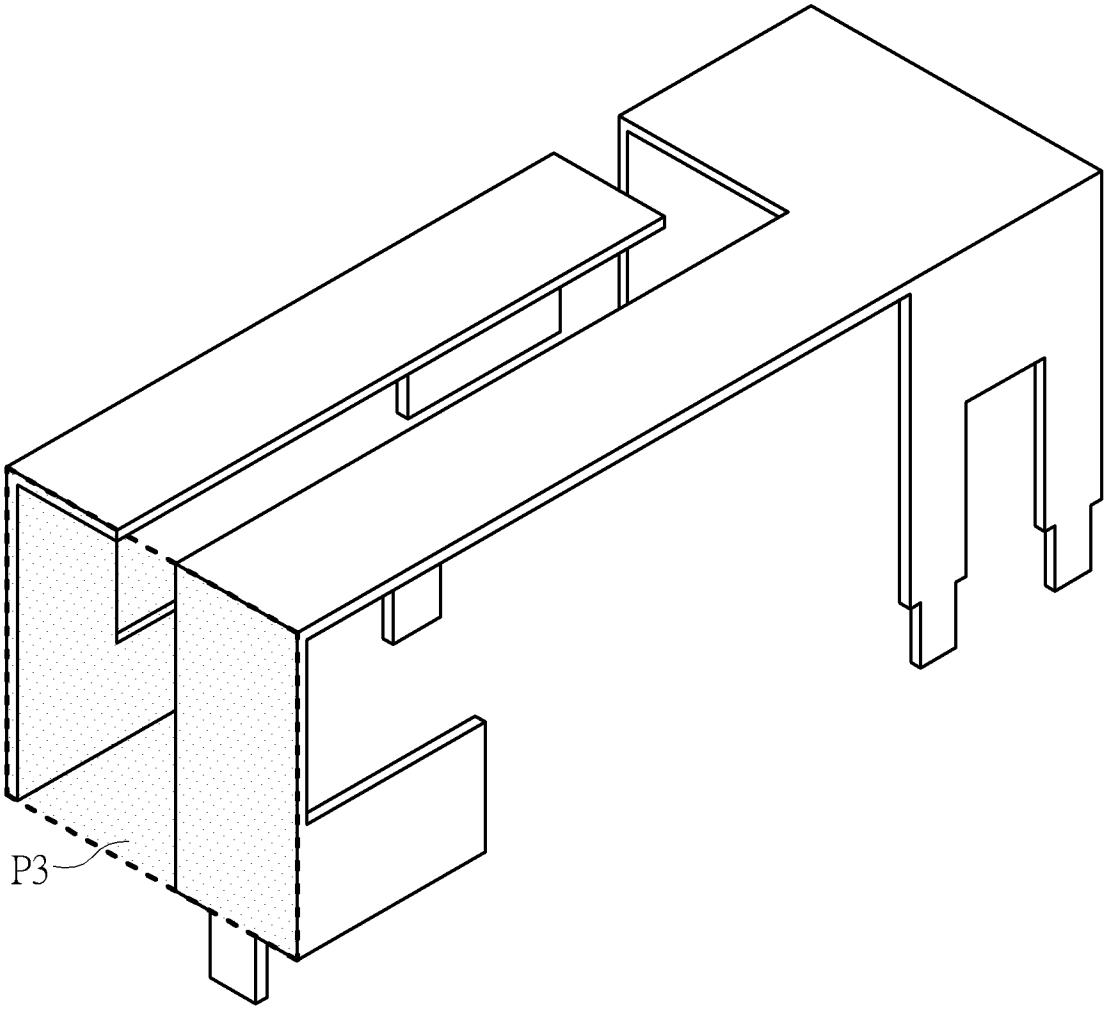
FIG. 7 shows the third plane of the proposed three-dimensional antenna design as shown in FIG. 2 according to an embodiment of the invention.
Figure 8:
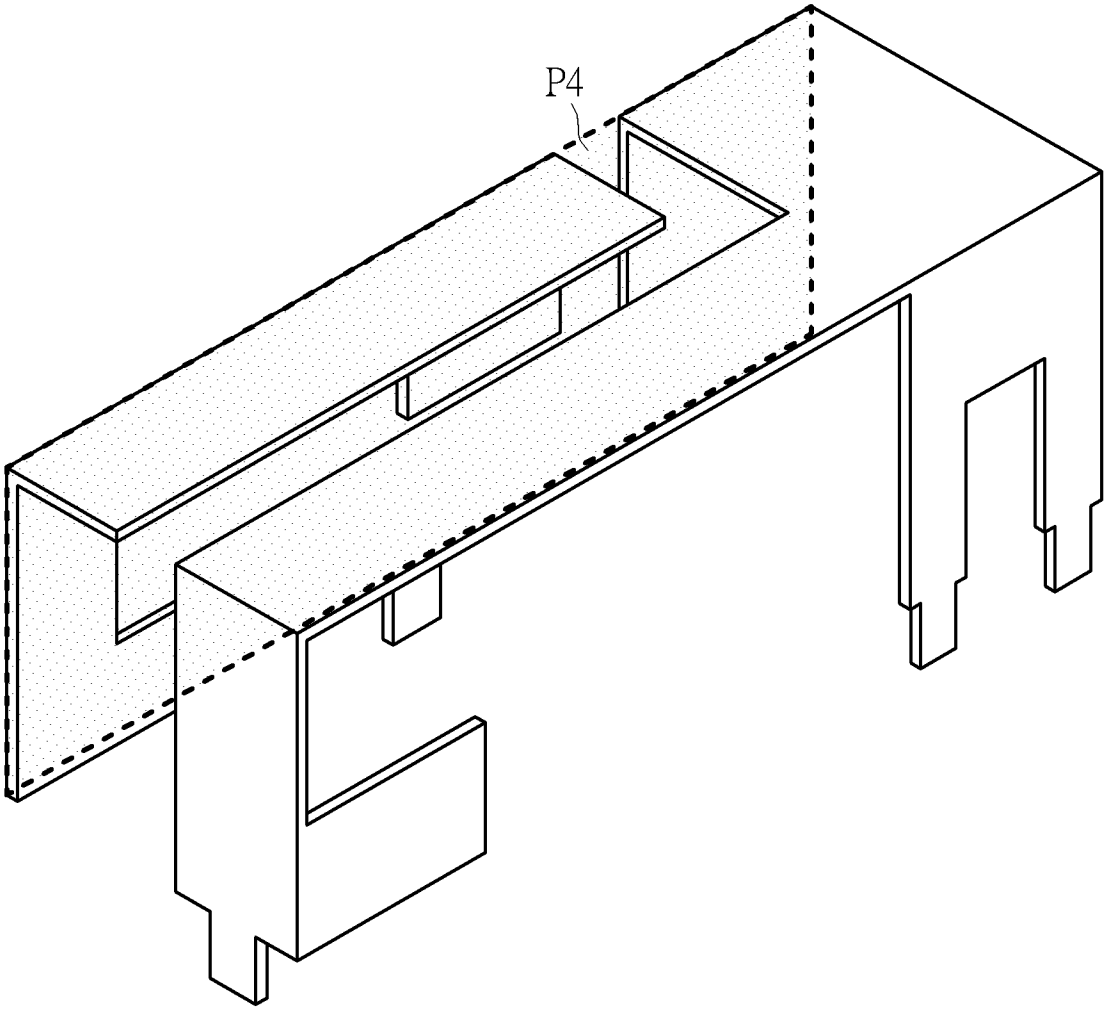
FIG. 8 shows the fourth plane of the proposed three-dimensional antenna design as shown in FIG. 2 according to an embodiment of the invention.

FIG. 5 shows the first plane P1 of the proposed three-dimensional antenna design as shown in FIG. 2 according to an embodiment of the invention. FIG. 6 shows the second plane P2 of the proposed three-dimensional antenna design as shown in FIG. 2 according to an embodiment of the invention. FIG. 7 shows the third plane P3 of the proposed three-dimensional antenna design as shown in FIG. 2 according to an embodiment of the invention. FIG. 8 shows the fourth plane P4 of the proposed three-dimensional antenna design as shown in FIG. 2 according to an embodiment of the invention. As discussed above, the aforementioned bent portions may make the first plane P1, the second plane P2 and the third plane P3 perpendicular to each other, make the second plane P2, the third plane P3 and the fourth plane P4 perpendicular to each other, and make the first plane P1 parallel to the fourth plane P4.

According to an embodiment of the invention, the feed pin 110, the short-circuit pin 120 and the connection portions 330 and 340 may be located on the first plane P1. The radiation branch 130 may comprise a plurality of radiation portions respectively located on the first plane P1, the second plane P2 and the third plane P3. The radiation branch 140 may comprise a plurality of radiation portions respectively located on the first plane P1, the second plane P2 and the fourth plane P4. The radiation branch 130 and the radiation branch 140 may also share the radiation portion located on the same plane. For example, the radiation portion located on the first plane P1 and coupled to the feed pin 110 and/or the short-circuit pin 120 may be shared by the radiation branch 130 and the radiation branch 140. In addition, the support portion 150 may be located on the third plane P3 and the support portion 160 may be located on the fourth plane P4.

According to an embodiment of the invention, the antenna 10 may be made by stamping or cutting a single metal sheet.

Figure 9:
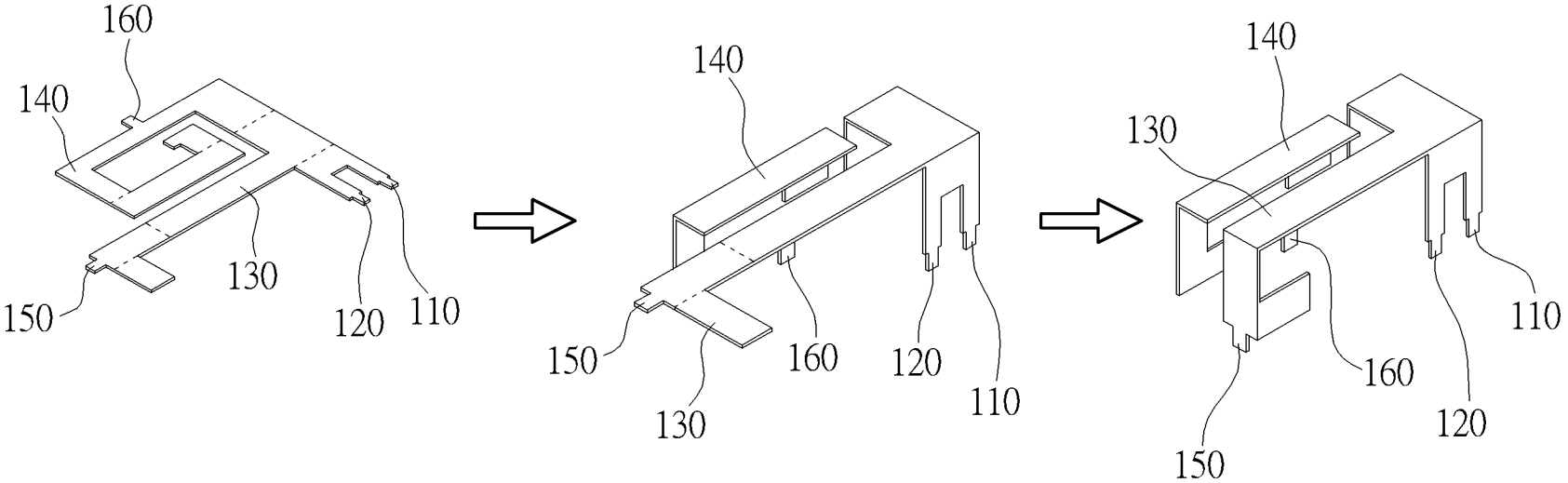
FIG. 9 is a schematic diagram showing the antenna manufacturing process according to an embodiment of the invention.

FIG. 9 is a schematic diagram showing the antenna manufacturing process according to an embodiment of the invention. As shown in FIG. 9, the proposed miniaturized broadband antenna may be manufactured by stamping or cutting a single metal sheet, and the three-dimensional structure as shown in FIG. 2 may be achieved by performing some simple bending steps.

In the embodiments of the invention, taking the structure shown in FIG. 2 as an example, by simply inserting the antenna downward onto the circuit substrate 310, the proposed miniaturized broadband antenna can be combined with other circuits on the circuit substrate 310. Therefore, the proposed antenna has the advantages of easy manufacture and simple assembly. In the embodiments of the invention, the combination of the miniaturized broadband antenna and other circuits on the circuit substrate 310 may form a wireless communication module or a wireless communication device, such as a Wireless Local Area Networks (WLAN) chip. In addition, since the proposed antenna structure has small size characteristics, the size of the circuit substrate 310 may be smaller than or equal to one quarter wavelength of the operating frequency of the antenna 10.

In the embodiments of the invention, the length s of the end of the radiation branch 130 is related to the first resonant frequency of the antenna, and the operating frequency of the antenna may be reduced when the length s is increased.

In the embodiments of the invention, the length l of the end of the radiation branch 140 is related to the second resonant frequency of the antenna, and the operating frequency of the antenna may be reduced when the length l is increased.

In the embodiments of the invention, by adequately adjusting the first resonant frequency and the second resonant frequency, the purpose of broadband antenna operations can be effectively achieved.

In the embodiments of the invention, the length g of the gap is related to the impedance matching of the antenna. The input impedance of the antenna may be changed by adjusting the length g of the gap. For example, when the length g is increased from 1.5 mm to 3.5 mm, better impedance matching can be achieved.

According to an embodiment of the invention, the wireless communication module comprising the proposed miniaturized broadband antenna may be installed on the circuit motherboard of another device (for example, a home electronic device), so as to make the other device to become a wireless communication device capable of performing wireless communication.

Figure 10:
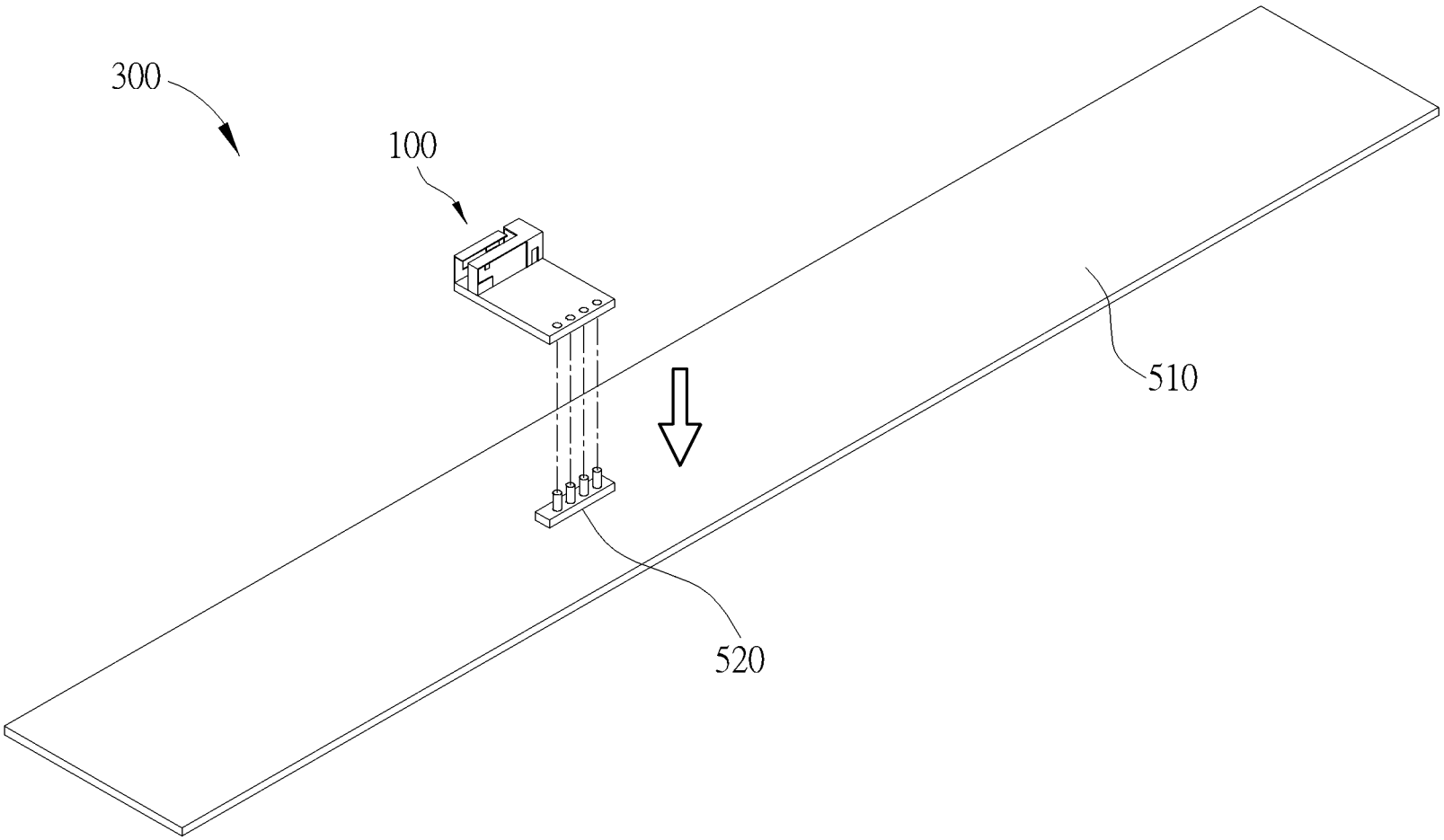
FIG. 10 is a schematic diagram showing the wireless communication device comprising the miniaturized broadband antenna according to an embodiment of the invention.

FIG. 10 is a schematic diagram showing the wireless communication device comprising the miniaturized broadband antenna according to an embodiment of the invention. The circuit motherboard 510 may comprise pins 520. The circuit substrate (the circuit child board) of the wireless communication module 100 may be connected to the circuit motherboard 510 of the wireless communication device 300 via the pins 520. In this manner, the wireless communication module 100 can be installed on the circuit motherboard 510 and the miniaturized broadband antenna can be installed on the circuit substrate of the wireless communication module 100 via the connection portions of the circuit substrate as shown in FIG. 2.

In the embodiments of the invention, the size of the circuit substrate may be smaller than or equal to one quarter wavelength of the operating frequency of the antenna, and the size of the circuit motherboard may be greater than one-half wavelength of the operating frequency of the antenna, or greater than the wavelength of the operating frequency of the antenna. In other words, the proposed miniaturized broadband antenna can be combined with the circuit motherboards with different sizes and different shapes (for example, the rectangle, square, circle or polygon, etc.). Therefore, the proposed miniaturized broadband antenna can be flexibly applied to various products, and can keep its original broadband operation characteristics. In addition, in the embodiments of the invention, the circuit substrate may be configured in any region of the circuit motherboard and the placement of the circuit substrate may be perpendicular to the circuit motherboard as shown in FIG. 10.

It should be noted that in the embodiments of the invention, the shape of circuit motherboard is not limited to what is shown in FIG. 10. That is, the circuit motherboard may be the circuit board of other shapes, such as rectangle, square, circle or polygon, etc.

In addition, it should be noted that, in the embodiments of the invention, the shape of the pins is not limited to what is shown in FIG. 10. For example, although the pins shown in FIG. 10 are arranged as a straight-line for making the wireless communication module 100 and the circuit motherboard 510 to be placed in parallel, the invention should not be limited thereto. In other embodiments of the invention, the pins may also be arranged in an L-shape for making the wireless communication module 100 to be placed vertically on the circuit motherboard 510. Therefore, in the embodiments of the invention, the pins can be arranged in any shape.

Based on the design of dual radiation branches in the proposed antenna structure, the miniaturized and broadband characteristics can be achieved. Not only the size of the antenna is reduced, making it to be able to be applied to the small size circuit board, but also great antenna radiation is achieved. In addition, since the antenna is integrally formed in one piece, only one metal conductor with proper bending is required for manufacturing the proposed antenna, and it can be directly soldered on the circuit substrate of a wireless communication module. Therefore, the proposed antenna has the advantages of simple fabrication, low cost and easy assembly, and also has the industrial applicability. In addition, the wireless communication module comprising the miniaturized broadband antenna can also be connected with another circuit motherboard via the pins or any connection forms, thus making it becomes a wireless communication device with wireless communication functionality.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An antenna, comprising:

a radiation body, comprising a first radiation branch and a second radiation branch, wherein the first radiation branch extends along a first direction and the second radiation branch extends along a second direction; and a feed pin, extending outward from the radiation body along a third direction, wherein first direction is perpendicular to the second direction and the third direction, and wherein the radiation body further comprises at least one bent portion and is selectively bent along a first fold line which is perpendicular to the third direction, and the at least one bent portion makes the second direction perpendicular to the third direction, and wherein the radiation body is further selectively bent along a second fold line which is perpendicular to the first direction, selectively bent along a third fold line which is parallel to the first direction, and selectively bent along a plurality of fourth fold lines perpendicular to the second direction.

2. The antenna of claim 1, wherein the antenna is a planar inversed-F antenna or a monopole antenna.

3. The antenna of claim 1, wherein the first radiation branch comprises a first radiation portion located on a first plane, a second radiation portion located on a second plane and a third radiation portion located on a third plane, and the radiation body comprises a plurality of bent portions that make the first plane, the second plane and the third plane perpendicular to each other.

4. The antenna of claim 1, wherein the second radiation branch comprises a first radiation portion located on a first plane, a second radiation portion located on a second plane and a third radiation portion located on a fourth plane, and the radiation body comprises a plurality of bent portions that make the second plane respectively perpendicular to the first plane and the fourth plane.

5. The antenna of claim 1, further comprising:

a short-circuit pin, extending outward from the radiation body along the third direction.

6. The antenna of claim 1, wherein a length of an end of the first radiation branch is related to a first resonant frequency of the antenna and a length of an end of the second radiation branch is related to a second resonant frequency of the antenna.

7. A wireless communication device, comprising:

a circuit substrate, comprising at least a first connection portion, a second connection portion and a ground plane; and an antenna, comprising:

a radiation body, comprising a first radiation branch and a second radiation branch, wherein the first radiation branch extends along a first direction and the second radiation branch extends along a second direction;

a feed pin, extending outward from the radiation body along a third direction and coupled to the first connection portion; and a short-circuit pin, extending outward from the radiation body along the third direction and coupled to the second connection portion and the ground plane, wherein first direction is perpendicular to the second direction and the third direction, and wherein the antenna further comprises at least one bent portion, the radiation body is selectively bent along a first fold line which is perpendicular to the third direction, and the at least one bent portion makes the second direction perpendicular to the third direction, and wherein the radiation body is further selectively bent along a second fold line which is perpendicular to the first direction, selectively bent along a third fold line which is parallel to the first direction, and selectively bent along a plurality of fourth fold lines perpendicular to the second direction.

8. The wireless communication device of claim 7, wherein the first radiation branch comprises a first radiation portion located on a first plane, a second radiation portion located on a second plane and a third radiation portion located on a third plane, and the antenna comprises a plurality of bent portions that make the first plane, the second plane and the third plane perpendicular to each other.

9. The wireless communication device of claim 7, wherein the second radiation branch comprises a first radiation portion located on a first plane, a second radiation portion located on a second plane and a third radiation portion located on a fourth plane, and the antenna comprises a plurality of bent portions that make the second plane respectively perpendicular to the first plane and the fourth plane.

10. The wireless communication device of claim 7, wherein a size of the circuit substrate is smaller than one quarter wavelength of an operating frequency of the antenna.

11. The wireless communication device of claim 7, wherein a length of an end of the first radiation branch is related to a first resonant frequency of the antenna and a length of an end of the second radiation branch is related to a second resonant frequency of the antenna.

12. A wireless communication device, comprising:

a circuit motherboard;

a circuit substrate, located on the circuit motherboard and comprising at least a first connection portion, a second connection portion and a ground plane; and an antenna, comprising:

a radiation body, comprising a first radiation branch and a second radiation branch, wherein the first radiation branch extends along a first direction and the second radiation branch extends along a second direction;

a feed pin, extending outward from the radiation body along a third direction and coupled to the first connection portion; and a short-circuit pin, extending outward from the radiation body along the third direction and coupled to the second connection portion and the ground plane, wherein first direction is perpendicular to the second direction and the third direction, and wherein the antenna is a three-dimensional antenna, the second direction is perpendicular to the third direction, the radiation body is bent along a first fold line which is perpendicular to the third direction, bent along a second fold line which is perpendicular to the first direction, bent along a third fold line which is parallel to the first direction, and bent along a plurality of fourth fold lines perpendicular to the second direction, and the first radiation branch comprises a first radiation portion located on a first plane, a second radiation portion located on a second plane and a third radiation portion located on a third plane, and the first plane, the second plane and the third plane are perpendicular to each other.

13. The wireless communication device of claim 12, wherein a size of the circuit substrate is smaller than one quarter wavelength of an operating frequency of the antenna.

14. The wireless communication device of claim 12, wherein a size of the circuit motherboard is greater than one-half wavelength of an operating frequency of the antenna.

15. The wireless communication device of claim 12, wherein the second radiation branch comprises a first radiation portion located on the first plane, a second radiation portion located on the second plane and a third radiation portion located on a fourth plane, the feed pin and the short-circuit pin are located on the first plane, and the second plane, the third plane and the fourth plane are perpendicular to each other.

16. The wireless communication device of claim 12, wherein a length of an end of the first radiation branch is related to a first resonant frequency of the antenna and a length of an end of the second radiation branch is related to a second resonant frequency of the antenna.

* * * * *